United States Patent [19]

Tupitsyn et al.

[11] Patent Number: 4,964,477

[45] Date of Patent: Oct. 23, 1990

[54] PNEUMATIC PERCUSSIVE DEVICE

[76] Inventors: Konstantin K. Tupitsyn, Frunze, 57a, kv. 115; Sergei Tupitsyn, Koshurnikova, 18, kv. 18; Veniamin Kamensky, Derzhavina, 5, kv. 78; Kiselev N. Jurievich, ulitsa Lineinaya, 37/1, kv. 33, all of Novosibirsk, U.S.S.R.

[21] Appl. No.: 355,171

[22] Filed: May 22, 1989

[51] Int. Cl.[5] ..... E21B 4/14

[52] U.S. Cl. ..... 175/296; 173/91; 175/297

[58] Field of Search ..... 175/19, 296, 297; 173/91, 90

[56] References Cited

U.S. PATENT DOCUMENTS 3,137,483 6/1964 Zinkiewicz ..... 173/91 X 3,431,984 3/1969 Buehler et al. ..... 175/297 X 4,250,972 2/1981 Schmidt ..... 173/91

4,690,225 9/1987 Tupitsyn et al. ..... 173/91 X

*Primary Examiner*—William P. Neuder

*Attorney, Agent, or Firm*—Burgess, Ryan and Wayne

[57] ABSTRACT

A pneumatic percussive device has a casing (1) accomodating a movable hammer piston dividing the interior space of the casing (1) into two chambers. One of these chambers (7) alternately communicates, by means of an air distribution arrangement (3) having a movable actuator member (8), with a compressed air source and with the environment. In addition, said chamber (7) communicates, via a throttling passage (27), with a cavity (10) of the air distribution arrangement (3) the pressure in which ensures movement of the actuator member to one of its limit positions.

6 Claims, 4 Drawing Sheets

PNEUMATIC PERCUSSIVE DEVICE

TECHNICAL FIELD

The present invention relates to mining technology, and more specifically, it deals with a pneumatic percussive device.

The present invention may be most advantageously used in pneumatic percussive tools such as pneumatic moles designed for forming boreholes in soil and rocks.

BACKGROUND OF THE INVENTION

Known in the art are pneumatic percussive devices having valve and spool air distribution arrangements and pneumatic devices in which air distribution is effected by the hammer piston. All such devices are characterized by the provision of a system of passages made either in the casing walls or in the hammer piston, which are necessary for controlling operation of the spool or valve and also for supplying compressed air to working chambers of the device and for discharging exhaust air from these chambers. The provision of such passages results, on the one hand, in a decrease in the net area of the hammer piston which, in turn, lowers the specific impact power and, on the other hand, complicates the hammer piston and casing thus bringing about superfluos stress concentrations so as to substantially reduce service life of these parts. This is true to the largest extent for underground tools such as pneumatic moles in which the diameter of the casing, hence of the hammer piston, is limited by the diameter of the hole, and the impact loads are taken up not only by the hammer piston, but also by the casing which functions as a working member as well.

Known in the art is a pneumatic percussive device (DE, C, 1132067), comprising a pile hammer lowered into a borehole and an independent air distribution arrangement installed on the ground level. The pile hammer is in the form of a simple impact work consisting of a tubular casing closed at both ends and a hammer piston mounted therein for axial movement. The hammer piston divides the interior space of the tubular casing into two chambers communicating with each other either through a throttling passage, or through a passage having a check valve, or by means of both. At least one of these chambers, which is referred to as the control chamber, communicates through a hose with the air distribution arrangement provided on the ground level.

The air distribution arrangement is generally in the form of an oscillating system consisting of a spool valve box and an actuator provided therein and made in the form of a spool or a valve adapted to perform oscillations either automatically or positively under the action of a drive mechanism, e.g. a cam drive. The self-oscillating spool is connected by means of levers and pivot joints to a pendulum having an adjustable weight.

For putting the pile hammer in operation, the actuator of the air distribution arrangement is automatically or positively driven to perform oscillations. During oscillations of the spool the hose connecting the controlled chamber of the pile hammer to the air distribution arrangement alternately communicates with a compressed air source and with the environment depending on position of the spool, whereby the controlled chamber of the pile hammer also alternately communicates with the compressed air source and with the environment. Consequently, pulsating pressure is built up in the controlled chamber. As both chambers of the pile hammer communicate with each other through the throttling passage or through the passage incorporating a check valve, rather than through a free passage, pressure in these chambers is always different. Under the action of the pressure difference in the chambers, the hammer piston performs reciprocations during which it imparts blows either to a working implement or to the casing-in the opposite direction. The desired direction of blows is ensured by a preset combination of parameters of the air distribution arrangement chosen by way of experiments.

In certain embodiments of the pile hammer there are no passages in the hammer piston and casing altogether. This makes the abovedescribed device advantageous over prior art pneumatic percussive devices having a spool or valve air distribution arrangements that cannot be implemented without a system of passages which are required for controlling the spool or valve and for discharging waste air from the chambers and admitting compressed air to the chambers.

The provision of a hose connecting the controlled chamber to the air distribution arrangement which is located at a substantial distance from the pile hammer results in an increase in the "dead volume" of this chamber by the amount of the volume of the interior space of the hose. At the same time, an increase in the "dead volume" of the chamber is known to result in an additional unproductive consumption of compressed air, hence in a lower efficiency. In addition, a substantial length of the hose limits the rate of pressure pulses effectively transmitted to the chamber, i.e. limits impact power of the pile hammer. In an ideal case, the rate of pressure pulses effectively transmitted through the hose per unit of time is determined by the formula:

$$\omega < \frac{V}{2L},$$

wherein $\omega$ is the rate of pulses;

L is the hose length;

V is the velocity of sound in the air.

In real life devices, the rate of effectively transmitted pulses is still lower.

Known in the art is a pneumatic percussive device (SU, A, 261319), comprising a casing and a hammer piston mounted in the casting for movement. The hammer piston divides the interior space of the casing into two chambers.

A working implement is incorporated in the front end part of the casing. A massive balancing piston is provided in the rear end part of the casing, which is in the form of a spool adapted to perform self-oscillatory movement when compressed air is supplied to the device. A longitudinal passage provided in the spool permanently communicates with a controlled chamber on one side and is communicatable with either a source of compressed and or the environment on the other side depending on position of the spool. Owing to the fact that the independent air distribution arrangement is incorporated in the casing of the percussive device, there is no need to use a hose for communication of the controlled chamber with the air distribution arrangement as was the case in the prior art pneumatic percussive device of DE, C, 1132067.

When compressed air is supplied to this device, the spool provided in the rear end part of the casing performs self-oscillations with respect to the casing. Depending on position of the spool during its oscillatory movement, the controlled chamber alternately communicates through the longitudinal passage of the spool with the compressed air source and with the environment. Therefore, the balancing piston which is made in the form of the spool functions not only as a balancing inertia member but also as an independent air distribution device establishing communication alternately between the controlled chamber of the device and the compressed air source and the environment. Under the action of pulsating pressure in the controlled chamber and air pressure in the other chamber, the hammer piston performs reciprocations during which it imparts blows to the working implement.

However, as the balancing piston functions as a balancing member as well, it has substantial dimensions and mass as well as the amplitude of oscillations so that the size and mass of the device as a whole also increase without bringing about any increase in the impact power. Consequently, the specific impact power of the device is lowered. Attempts made to reduce mass and size of this prior art device by way of rational choice of dimensions, mass and swing of oscillations of the balancing piston and by lowering amplitude of oscillations of the balancing piston by means of limiting abutments failed. Thus reducing mass of the balancing piston to lower mass of the device as a whole inevitably result in the increase in amplitude of its oscillations so that length of the casing increases and the reduction of mass of the device as a whole is not achieved because of an increase in mass of the casing. Reducing amplitude of oscillations of the balancing piston by means of the limiting abutments as is the case in known pneumatic percussive devices with valve air distribution arrangements in which the valve remains stationary alternately in one and other position is also impossible for two reasons. Firstly, the balancing piston cannot be stopped if one wants it to perform its function. Secondly, this piston being a self-oscillating member, it cannot remain stationary after its engagement with the abutment since the very principle of its self-oscillation movement involves the development of a rebound force under the action of which the balancing piston is instantly reversed after its stoppage. As a result, frequency of oscillatory movement of the balancing piston is only determined by a very short time of its shift between the two abutments and it will become too high as to rule out normal operation of the device.

SUMMARY OF THE INVENTION

The main object of the present invention is to provide a pneumatic percussive device with such a construction of an air distribution arrangement that will enable one to considerably reduce mass and size of the device and to retain its comparatively high impact power, with all the merits inherent in the pneumatic percussive device with a single chamber under control.

This object is accomplished by providing a pneumatic percussive device having a casing accomodating a movable hammer piston dividing the interior space of the casing into two chambers, the first chamber being defined by the casing walls and the hammer piston and the second chamber being defined by the hammer piston and an air distribution arrangement accomodated in the casing and having a movable actuator member dividing the interior space of the air distribution arrangement into at least two cavities, the pressure in the first cavity ensuring movement of the actuator member to one of its limit positions, the second cavity permanently communicating with the second chamber and alternately communicating with a compressed air source and the environment. According to the invention, the first cavity of the air distribution arrangement communicates with the second chamber via a throttling passage. The provision of the throttling passage establishing communication between said second chamber and first cavity prevents an instantaneous development of a force that changes direction of movement of the actuator member after its stoppage in one of its limit positions. During its self-oscillatory movement between the two abutments, the actuator member can thus stop in each of its limit positions, the stoppage time in one position being equal to the time for filling said first cavity of the air distribution arrangement with air through the throttling passage and the stoppage time in the other position being equal to the time for discharging compressed air through this passage from said first cavity. The law of oscillatory movement of the actuator member in this case is determined by parameters of the throttling passage and said first cavity of the air distribution arrangement, but it does not substantially depend on its inertia properties. As a result, an actuator member may be used the size and amplitude of oscillations of which can be reduced to the values sufficient only for enabling free admission and discharge of air. In comparison with the device disclosed in SU,A, 261319, size and mass of this device are reduced as a whole without a reduction in its impact power so that the specific impact power, i.e. the impact power-to-mass or volume ratio of the device increases.

It is preferred that the first cavity of the air distribution arrangement and the second chamber of the casing communicate with each other through at least one auxiliary throttling passage, the outlet opening of which on the side of the first cavity of the air distribution arrangement is provided with a check valve secured to a wall of the air distribution arrangement.

This facility allows an optimum time for admission of compressed air to said second chamber to be chosen with a preset time for exhaust of waste air therefrom.

To provide for the possibility of choice of an optimum time for discharge of compressed air from said second chamber with a preset time for air admission thereto, it is preferred that the interior space of the air distribution arrangement and the second chamber of the casing communicate with each other through at least one auxiliary throttling passage having an outlet opening thereof on the side of the second chamber of the casing provided with a check valve secured to a wall of the air distribution arrangement.

To prevent uncontrolled air overflows from the air line into the first cavity of the air distribution arrangement, it is preferred, on the contrary, that a diaphragm be provided on the surface of the actuator member acted upon by compressed air pressure in said first cavity, the diaphragm being secured to the periphery of the air distribution casing.

BRIEF DESCRIPTION OF THE DRAWINGS

The invention will now be described with reference to a specific embodiment illustrated in the accompanying drawings, in which.

BEST MODE FOR CARRYING OUT THE INVENTION

Figure 1:
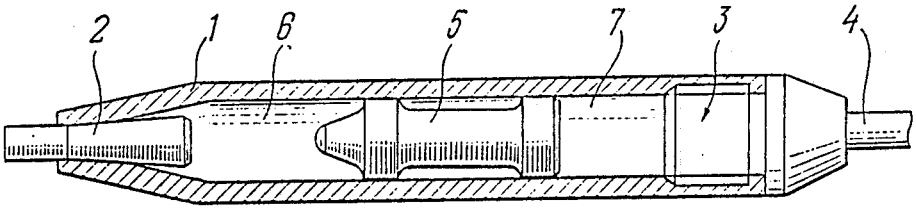
FIG. 1 is a general view of a pneumatic percussive device according to the invention.

A pneumatic percussive device comprises a casing 1 (FIG. 1), e.g. of a tubular shape.

A working implement 2 is attached to one end face of the casing, and an air distribution arrangement 3 with an air supply hose 4 is provided at the other end of the casing. A hammer piston 5 is mounted for axial movement in the casing 1. The hammer piston 5 divides the interior space of the casing into two chambers 6, 7. The first chamber 6 is defined by the walls of the casing 1, the hammer piston 5 and the working implement 2. The second chamber 7 is defined by the walls of the casing 1, hammer piston 5 and the air distribution arrangement 3. The first and second chambers 6, 7 communicate with each other by any appropriate known means (not shown), limiting overflows of air from the second chamber 7 to the first chamber 6. A known means limiting overflows of air between the first and second chambers 6 and 7 may be in the form of a throttling passage which may be in the form of an annular space between the hammer piston 5 and the casing 1 or in the form of a passage incorporating a check valve, or both.

Figure 2:
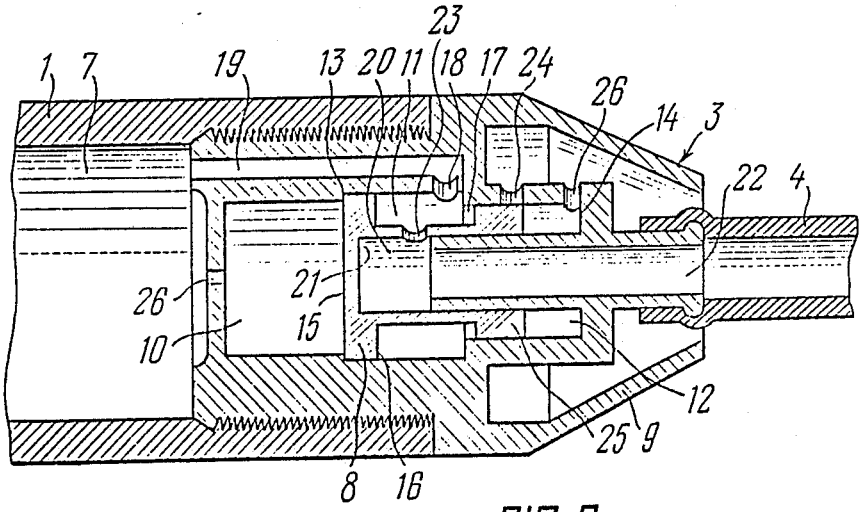
FIG. 2 is an embodiment of an air distribution arrangement having its actuator member which is in a position allowing compressed air to be admitted to one of chambers of the device.
Figure 3:
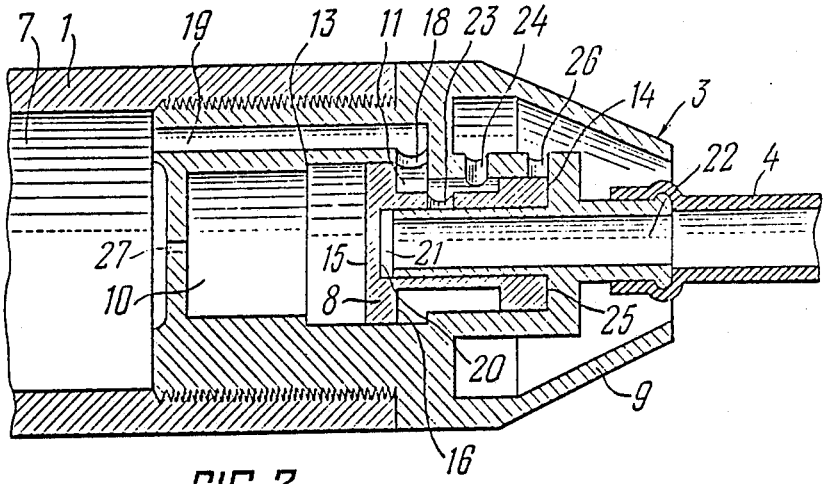
FIG. 3 is the embodiment of FIG. 2 showing a position of the actuator member allowing waste air to be exhausted from said chamber of the device.

The air distribution arrangement 3 has a movable actuator member 8 (FIG. 2) dividing the interior space of a casing 9 of the air distribution arrangement 3 into at least two cavities, and in this particular case, into three cavities 10, 11, 12 since the actuator member 8 is made in the form of a stepped slide, that is, a slide having a differential area mounted coaxially with the hammer piston 5 (FIG. 1) in the casing 9 (FIG. 2) of the air distribution arrangement 3 for reciprocations between abutments 13 and 14 provided in the casing 9 of the air distribution arrangement 3. The first cavity 10 is defined by the walls of the casing 9 of the air distribution arrangement 3 and an end face 15 of the actuator member 8. Pressure in the first cavity 10 ensures a shift of the actuator member 8 to one of its limit positions. The second cavity 11 is defined by the walls of the casing 9 and annular end faces 16 and 17. The second cavity 11 permanently communicates through communicating radial and longitudinal passages 18 and 19 respectively, with the second chamber 7 of the device. The actuator member 8 has a cavity 20 in the form of a sleeve having a bottom 21. The cavity 20 communicates, via a passage 22, with the air supply hose 4 and, via a radial passage 23, and the second cavity 11, which, depending on position of the actuator member 8 alternately communicates with the air supply line when in one position, via the radial passage 23, or, via the radial passage 24, with the environment when the actuator member 8 is in the other position (FIG. 3). The third cavity 12 defined by an end face 25 and the walls of the casing 9 of the air distribution device permanently communicates with the environment via a radial passage 26 (FIG. 2). The first cavity 10 permanently communicates with the second chamber 7 via a throttling passage 27 and functions as a receiver.

Figure 4:
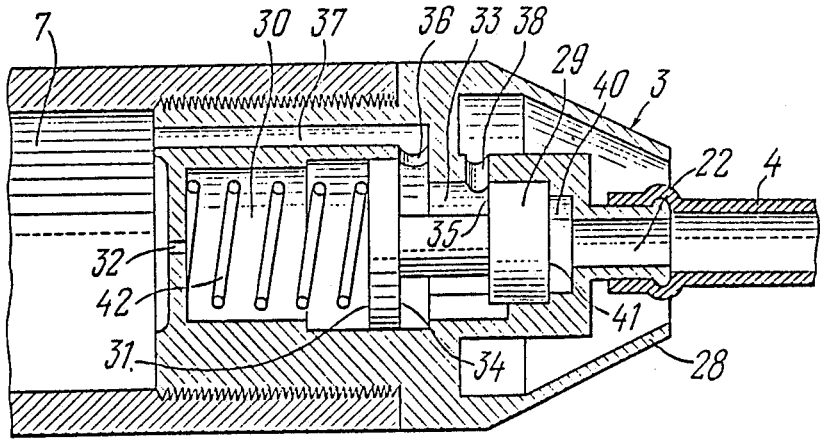
FIG. 4 is an embodiment of an air distribution arrangement using a spring, shown in a position allowing compressed air to be admitted to one of chambers of the device.
Figure 5:
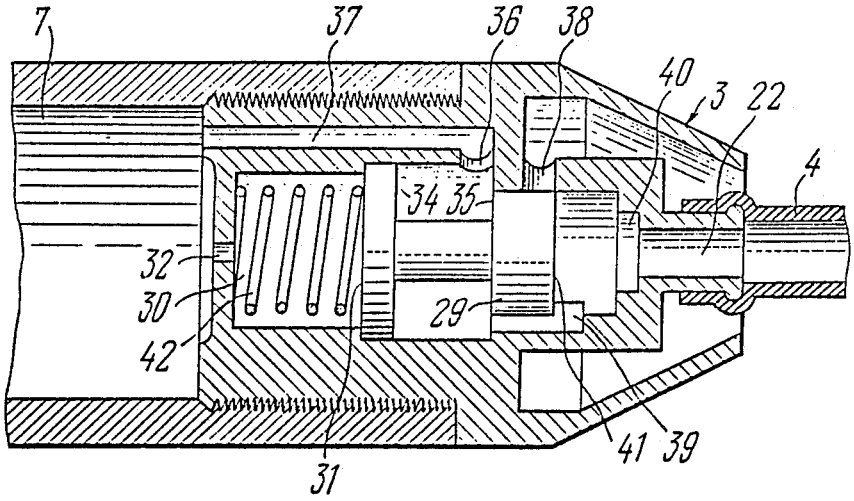
FIG. 5 an embodiment of FIG. 4, but showing the actuator member in a position allowing waste air to be exhausted from said chamber of the device.

FIGS. 4, 5 show an embodiment of a casing 28 of the air distribution arrangement 3 and an actuator member 29 of another type in which there is no cavity in the form of a sleeve inside the actuator member 29. In this case a first cavity 30 defined by the walls of the casing 28 and an end face 31 of the actuator member 29 directly communicates, via a throttling passage 32, with the second chamber 7 of the device and functions as a receiver. A second cavity 33 defined by a wall of the casing 28 and annular end faces 34 and 35 permanently communicates with the second chamber 7 through communicating radial and longitudinal passages 36 and 37, respectively. Depending on position of the actuator member 29, the second cavity 33 may communicate either with the environment through a radial passage 38 (in the position shown in FIG. 4) or with the interior of the air supply hose 4 through passages 39 and 22 (in the position of the actuator member 29 shown in FIG. 5). A third cavity 40 defined by the walls of the casing 28 and an end face 41 of the actuator member 29 permanently communicates, via the passage 22, with the air supply hose 4. A spring 42 is provided in the first cavity 30 between the wall of the casing 28 and the end face 31 of the actuator member 29, the force of the spring placing the actuator member 29 in the position shown in FIG. 4 in which the second chamber 7 communicates with the environment.

Figure 6:
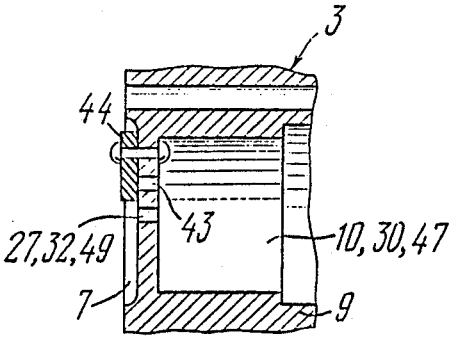
FIG. 6 is an embodiment of an air distribution arrangement having two throttling passages allowing compressed air to be admitted to one chamber of the device only.

To allow for a choice of an optimum time for exhaust of compressed air from the second chamber 7 with a preset time for air admission thereto, the first cavity 10 (FIG. 6) communicates with the second chamber 7 through an auxiliary throttling passage 43. The outlet opening of the throttling passage on the side of the second chamber 7 incorporates a check valve 44 secured to the wall of the casing 9 of the air distribution arrangement 3 for allowing air to pass to the second chamber 7 only.

If it is desired to make choice of an optimum time for compressed air admission to the second chamber 7 with a preset time for exhaust of waste air therefrom, the outlet opening of the auxiliary throttling passage 43 incorporates on the side of the first cavity 10 a check valve 45 secured to the wall of the casing 9 of the air distribution arrangement 3 which allows compressed air to be only admitted to the first cavity 10.

Figure 8:
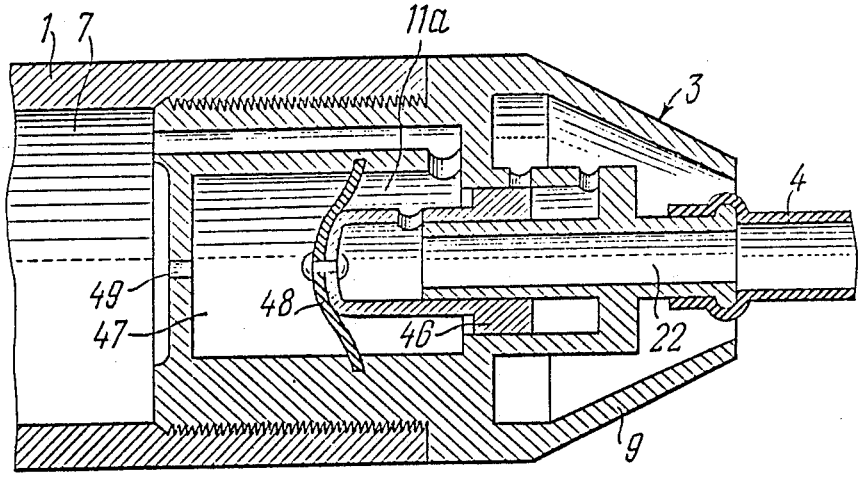
FIG. 8 is an embodiment of an air distribution arrangement using a diaphragm.

FIG. 8 shows an embodiment of the air distribution arrangement 3 similar to that described with reference to FIG. 1, but having a different structural form of an actuator member 46. This actuator member 46 has an end face in the form of a flexible diaphragm 48 secured to the periphery of the casing 9 of the air distribution arrangement 3, said diaphragm 48 defining a first cavity 47.

The pneumatic percussive device according to the invention functions in the following manner.

When compressed air is fed to the device according to the invention through the air supply hose 4 (FIG. 2) from a compressed air source (not shown), the actuator member 8 in the form of a stepped slide moves under the action of compressed air pressure upon the bottom 21 of the sleeve 20 until it engages with the abutment 13, i.e. until it is in a position in which compressed air supplied through the hose 4 fills the second chamber 7 of the casing 1 through the passage 22, the cavity 20, the radial passage 23 of the actuator member 8, the second cavity 11, the radial and longitudinal passages 18 and 19 of the casing 9 of the air distribution arrangement 3. When compressed air is admitted to the second chamber 7, an additional force applied on the part of the second cavity 11 to the end face 16 acts upon the actuator member 8 to press the actuator member 8 against the abutment 13. The fact is that when the actuator member 8 is in FIG. 2 position, the above second cavity 11 is connected with the compressed air source and owing to that, is under the pressure. The pressure in the cavity 11 creates said additional force. At the same time, pressure in the first cavity 10 increases gradually since its charging with compressed air occurs through the throttling passage 27 connecting this first cavity 10 functioning as a receiver to the second chamber 7. Admission of compressed air to the second chamber 7 lasts until air pressure in the first cavity 10 reaches during its filling a value which is sufficient to shift the actuator member 8 to the other position, i.e. until its engagement with the abutment 14 as shown in FIG. 3. The actuator member 8 moves from the position of FIG. 2 to the position of FIG. 3 due to the fact that the area of the end face 15 exceeds the total areas of the end faces 21 and 16 (see FIG. 2 for example), i.e., due to the fact that said actuator member 8 is made in the form of a slide having differential area.

In the new position of the actuator member 8, admission of compressed air to the second chamber 7 is stopped as the radial passage 23 is shut-off, and waste air is exhausted, i.e. in this position of the actuator member 8 the second chamber 7 communicates with the environment via the longitudinal and radial passages 19 and 18 of the casing 9 of the air distribution arrangement 3, its second cavity 11 and radial passage 24. During air exhaust, air pressure in the second chamber 7 abruptly decreases, but pressure in the first cavity 10 decreases gradually during a comparatively long times since its discharge occurs through the throttling passage 27. The actuator member 8 remains in this position until pressure in the first cavity 10 decreases to a value at which the force of pressure acting upon the end face 15 of the actuator member 8 becomes lower than the force of the air line pressure in the cavity 20 acting upon the bottom 21. Then the abovedescribed process of the self-oscillation movement of the actuator member 8 with stoppages at two limit positions is regularly repeated.

Depending on position in which the actuator member 8 is located, the second chamber 7 communicates either with a source of compressed air and is insulated from the environment, or with the environment and is insulated from the source of compressed air. Therefore, pulsating pressure develops in the second chamber 7 of the device when compressed air is supplied through the air supply hose 4. As the first chamber 6 (FIG. 1) and the second chamber 7 communicate through any appropriate known means (not shown) restricting air passage from one chamber 7 (6) to another rather than through an unobstructed passage, pressure in the first and second chambers 6, 7 is different. Under the action of the pressure difference between the chambers 6, 7 of the device, the hammer piston 5 performs reciprocations in the casing 1. One can choose such a combination of parameters of the air distribution arrangement 3 by way of experiments that the hammer piston 5 will impart blows to the working implement 2 during reciprocations in the casing 1 every cycle of operation of the air distribution arrangement 3.

Operation of the air distribution arrangement 3 the embodiment of which is shown in FIGS. 4, 5 is identical to operation of the air distribution arrangement 3 shown in FIGS. 2, 3 as regards functions.

When compressed air is admitted to the device through the air supply hose 4 (FIG. 4), the actuator member 29 is moved under the action of air pressure upon the end face 41 thereof in a position (FIG. 5) in which the second chamber 7 of the casing 1 communicates, via the passages 37, 36, 39 and 22, with a compressed air source so that compressed air is admitted to the second chamber 7. During admission of compressed air, an additional force counteracting the force of the spring 42 and caused by pressure acting upon the end face 34 acts upon the actuator member 29. The admission lasts until pressure in the first cavity 30 during its filling with compressed air through the throttling passage 32 reaches a value which is sufficient for shifting the actuator member 29 to a position in which the second chamber 7 (FIG. 4) communicates, via the passages 37, 36 and 38, with the environment. In this position of the actuator member 29 waste air is exhausted from the second chamber 7. Simultaneously with the exhaust, the first cavity 30 functioning as a receiver is discharged through the throttling passage 32 so that the actuator member 29 is again shifted to a position allowing compressed air to be admitted to the second chamber 7. The abovedescribed process is then repeated. Operation of the device as a whole is similar to operation of the device with the air distribution arrangement described with reference to FIGS. 2, 3.

Figure 7:
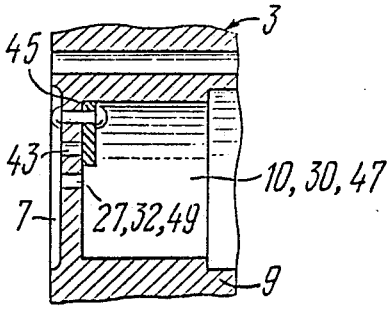
FIG. 7 is an embodiment of an air distribution arrangement having two throttling passages allowing compressed air to be admitted only to the interior space of the air distribution arrangement.

Operation of the device according to the invention using the air distribution arrangement 3 having an auxiliary throttling passage 43 (FIG. 7) with an outlet opening thereof incorporating the check valve 27 differs from that described above only in the fact that charging of the first cavity 10 is effected through the throttling passage 27 and the auxiliary throttling passage 37 and discharging is effected through ony throttling passage only.

If the outlet opening of the auxiliary throttling passage 43 is provided with the check valve 44 (FIG. 6), the first cavity 10 is discharged through the throttling passage 27 and the auxiliary throttling passage 43.

Operation of the device using the air distribution arrangement 3 with the diaphragm 48 (FIG. 8) is similar to operation of the device described with reference to FIGS. 2, 3. The difference resides in that the diaphragm 48 functions as the end face defining the first cavity 47 communicating with the second chamber 7 through the throttling passage 47.

The number of embodiments of the actuator member 8 and air distribution arrangement 3 is not limited to the two embodiments shown in FIGS. 2, 3 and 4, 5. Air distribution arrangements having different designs of the actuator member can be used, however, with any embodiment thereof, it is necessary that there shall be at least one throttling passage establishing communication between a chamber of the casing alternately communicating with a compressed air source and the environment with a cavity of the air distribution arrangement the pressure in which ensures movement of the actuator member to one of its limit positions.

In comparison with the prior art, the pneumatic percussive device according to the invention has an air distribution arrangement of minimum mass and size. This makes it possible to lower size and mass of the device as a whole without compromising its impact power while retaining all advantages of pneumatic percussive devices having a single controlled chamber. As a result, the specific impact power, i.e. the power-to-mass or volume ratio of the device increases. On the other hand, if mass and size of the device according to the invention remain the same as before, absolute impact power of the device increases by virtue of an increase in its specific power which, in the end of the day, results in an increase in productivity in applications of this device.

Industrial Applicability

The invention is most preferably used for forming holes used in construction engineering of underground utility systems of various use by tunneling.

We claim:

1. A pneumatic percussive device, comprising a casing (1), a movable hammer piston (5) accommodated in the casing (1) dividing the interior space of the casing (1) into two chambers (6, 7), the first chamber (6) being defined by walls of the casing (1) and the hammer piston (5), and the second chamber (7) being defined by the hammer piston and an air distribution arrangement (3) accommodated in the casing (1) and having a movable actuator member (8, 29, 46) dividing the interior space of the air distribution arrangement (3) into at least two cavities (10, 30, 47 and 11, 33, 11*a*), the first cavity (10, 30, 47) permanently communicating with the second chamber (7) by means of a throttling passage (27, 32, 49), the pressure in said first cavity (10, 30, 47) ensuring movement of the actuator member (8, 29, 46) to one of its limit positions, the second cavity (11, 33, 11*a*) permanently communicating with the second chamber (7) and alternately communicating with a compressed air source and the environment.

2. A pneumatic percussive device according to claim 1, in which the first cavity (10, 30, 47) of the air distribution arrangement (3) and the second chamber (7) of the casing (1) communicate with each other through at least one auxiliary throttling passage (43) having its outlet opening on the side of the second chamber (7) incorporating a check valve (44) secured to a wall of the air distribution arrangement (3) for allowing air to pass to the second chamber (7) only.

3. A pneumatic percussive device according to claim 1, in which the first cavity (10, 30, 47) of the air distribution arrangement (3) and the second chamber (7) of the casing (1) communicate with each other through at least one auxiliary throttling passage (43) having its outlet opening on the side of the first cavity (10, 30, 47) of the air distribution arrangement (3) incorporating a check valve (45) secured to a wall of the air distribution arrangement (3) for allowing air to pass to the first cavity (10, 30, 47) only.

4. A pneumatic percussive device according to claim 1, in which a diaphragm (48) is provided on the surface of the actuator member (8) acted upon by compressed air pressure in the first cavity (47), the diaphragm being secured to the periphery of a casing (9) of the air distribution arrangement (3).

5. A pneumatic percussive device according to claim 1, in which the air distribution arrangement (3) is provided with the actuator member (8) which is capable to move between abutments (13) and (14) provided in a casing (9) of the air distribution arrangement (3), said actuator member (8) being made in the form of a three stepped slide having end faces (15) and (25), annular end faces (16) and (17) being verges between the first step and the second step, and between the second step and the third step of said actuator member (8) respectively, said actuator member (8) further having a cavity (20) with a bottom (21), the interior space of said air distribution arrangement (3) being divided into three cavities (10, 11, 12), the first cavity (10) being defined by the walls of the casing (9) of the air distribution arrangement (3) and the end face (15) of the actuator member (8), the second cavity (11) being defined by the walls of the casing (9) of the air distribution arrangement (3), and the annular end faces (16) and (17) of the actuator member (8), the third cavity (12) being defined by the end face (25) of the actuator member (8) and the walls of the casing (9) of the air distribution arrangement (3), said third cavity (12) permanently communicating with the environment, said cavity (20) permanently communicating with the compressed air source and alternately communicating with the second cavity (11), when the actuator member (8) is near the abutment (13) and being insulated from said second cavity (11) when the actuator member is near the abutment (14).

6. A pneumatic percussive device according to claim 1, in which the air distribution arrangement (3) is provided with the actuator member (29), which is capable to move between abutments (13) and (14) provided in a casing (28) of the air distribution arrangement (3), said actuator member (29) being made in the form of a three stepped slide having end faces (31) and (41), annular end faces (34) and (35) being verges between the first step and the second step, and between the second step and the third step of said actuator member (29) respectively, said actuator member (29) dividing the interior space of said air distribution arrangement (3) into three cavities (30, 33, 40), the first cavity (30) being defined by the walls of the casing (28) of the air distribution arrangement (3) and the end face (31) of the actuator member (29), said first cavity (30) having a spring (42) installed between the wall of the casing (28) of the air distribution arrangement (3) and the end face (31) of the actuator member (29), the said spring (42) pressing the actuator member (25) to the abutment (14), the second cavity (33) being defined by the walls of the casing (28) of the air distribution arrangement (3) and the annular end faces (34) and (35) of said actuator member (29), the third cavity (40) being defined by the end face (41) of the actuator member (29) and the walls of the casing (28) of the air distribution arrangement (3), said third cavity (40) permanently communicating with the compressed air source.

* * * * *